US007759612B2

(12) United States Patent
Last et al.

(10) Patent No.: US 7,759,612 B2
(45) Date of Patent: Jul. 20, 2010

(54) GLOW PLUG COMPRISING A PRESSURE SENSOR AND MOTOR EQUIPPED THEREWITH

(75) Inventors: Bernd Last, Reutlingen (DE); Michel Boucard, Tournefeuille (FR); Cyrille Patri, Toulouse (FR); Alain Ramond, Merville (FR)

(73) Assignee: Continental Automotive France, Toulouse (FR)

( * ) Notice: Subject to any disclaimer, the term of this patent is extended or adjusted under 35 U.S.C. 154(b) by 545 days.

(21) Appl. No.: 10/577,150

(22) PCT Filed: Oct. 25, 2004

(86) PCT No.: PCT/EP2004/012026

§ 371 (c)(1),
(2), (4) Date: Sep. 1, 2006

(87) PCT Pub. No.: WO2005/040681

PCT Pub. Date: May 6, 2005

(65) Prior Publication Data

US 2007/0163329 A1 Jul. 19, 2007

(30) Foreign Application Priority Data

Oct. 29, 2003 (FR) ..... 03 12682

(51) Int. Cl.
*F23Q 7/00* (2006.01)
*F02N 1/00* (2006.01)

(52) U.S. Cl. ..... 219/260; 123/179.24

(58) Field of Classification Search ..... 219/260, 219/261, 262, 263, 264, 265, 266, 267, 268, 219/269, 270; 123/179.6, 179.1, 266, 41.32, 123/309, 310, 329–339.1, 406.11, 400.14, 123/145 R–145 C, 179.24; 73/35.12; 60/39.01–39.927
See application file for complete search history.

(56) References Cited

U.S. PATENT DOCUMENTS 7,444,973 B2 * 11/2008 Boucard et al. ..... 123/179.6
2005/0061063 A1 3/2005 Haussner et al.

FOREIGN PATENT DOCUMENTS

| | | |
|---|---|---|
| DE | 196 80 912 | 4/2001 |
| EP | 1517086 | 3/2005 |
| FR | 2 824 114 | 10/2002 |
| JP | 59 085932 A * | 9/1984 |

OTHER PUBLICATIONS

Patent Abstracts of Japan, vol. 008, No. 202 (P-300), Sep. 14, 1984 & JP 59 085932 A (Nippon Jidosha Buhin Sogo Kenkyusho KK), May 18, 1984 abstract.
Patent Abstracts of Japan, vol. 2003, No. 03, May 5, 2003 & JP 2002 339793 A (Nippon Soken Inc; Toyota Motor Corp), Nov. 27, 2002 abstract.

* cited by examiner

*Primary Examiner*—Daniel L Robinson
(74) *Attorney, Agent, or Firm*—Young & Thompson

(57) ABSTRACT

A glow plug (1), includes a pressure sensor (90), suitable for measuring the internal pressure of a motor cylinder in which the plug (1) is housed, a body (10) to be secured to the motor and a finger (20) in which a heater electrode is housed. The sensor (90) is firmly secured to the body (10) by the upper face thereof and rests on the finger (20), so that the pressure exerted on the finger (20) presses the sensor against the body (10).

7 Claims, 4 Drawing Sheets

GLOW PLUG COMPRISING A PRESSURE SENSOR AND MOTOR EQUIPPED THEREWITH

The present invention concerns a glow plug comprising a pressure sensor making it possible to measure the pressure of an engine cylinder in which the glow plug is accommodated.

A glow plug is known comprising a pressure sensor adapted to measure the internal pressure of an engine cylinder in which the glow plug is accommodated, a body adapted to be fixed to the engine and a finger in which a pre-heating electrode is accommodated.

As can be seen in FIG. 1 (which illustrates a section view of a glow plug of the prior art), in order to be able to measure the pressure in the cylinder without making any major modification to the structure of the glow plug, the sensor is disposed between the body on which it bears, and a nut connected to the upper end of a core which transmits the electrical energy to the pre-heating electrode and which extends the finger in the body and beyond by passing through the sensor.

The pressure within the cylinder is felt by the finger of the glow plug and the variations in pressure undergone by the finger are transmitted to the sensor through the core which is connected thereto.

However, such a system has several drawbacks,

First of all, an excess pressure exerted on the finger results at the sensor as a reduction in pressure given that the nut linking the core (and consequently the finger) to the sensor is disposed above the latter. On producing the glow plug it is thus typically necessary to stress the sensor by sufficient tightening for it to be able to measure the entire expected pressure range, but without reaching too high a stress which would risk damaging the piezoelectric member of the sensor.

Secondly, the vibrations of the core, due to the operation of the engine, give rise to a vibration of the sensor to which the core is connected via the nut, which induces interference in the pressure measurement.

Thirdly, the electrical connectors used to connect the sensor to the electric circuit are themselves also subject to vibrations which cause Interference in the pressure measurement.

The present invention alms to solve at least some of the aforementioned problems by providing a glow plug comprising a pressure sensor which does not require pre-stressing and of which the intended operation is not perturbed by parasitic vibrations.

According to the invention, in the glow plug of the aforementioned type, the sensor is connected to the body by its upper surface and bears against the finger, such that the pressure exerted on the finger compresses it against the body.

Thus, to the compressions undergone by the finger there correspond compressions undergone by the sensor which thus no longer needs to be pre-stressed. Furthermore, since the sensor is disposed between the body and the finger, it is no longer in contact with the core and, thereby, the vibrations of the latter no longer generate Interference with regard to the sensor. Moreover, the parasitic vibrations of the connectors of the sensor are absorbed by the body to which the sensor is connected.

It is to be noted that the invention also applies to an internal combustion engine comprising at least one cylinder and one glow plug as presented here, the pressure sensor thus being adapted to measure the internal pressure of the cylinder in which the glow plug is accommodated and the body of the latter being fixed to the engine.

Other features and advantages will appear in the description of the embodiment given by way of non-limiting example and illustrated by the accompanying drawings in which.

Figure 1:
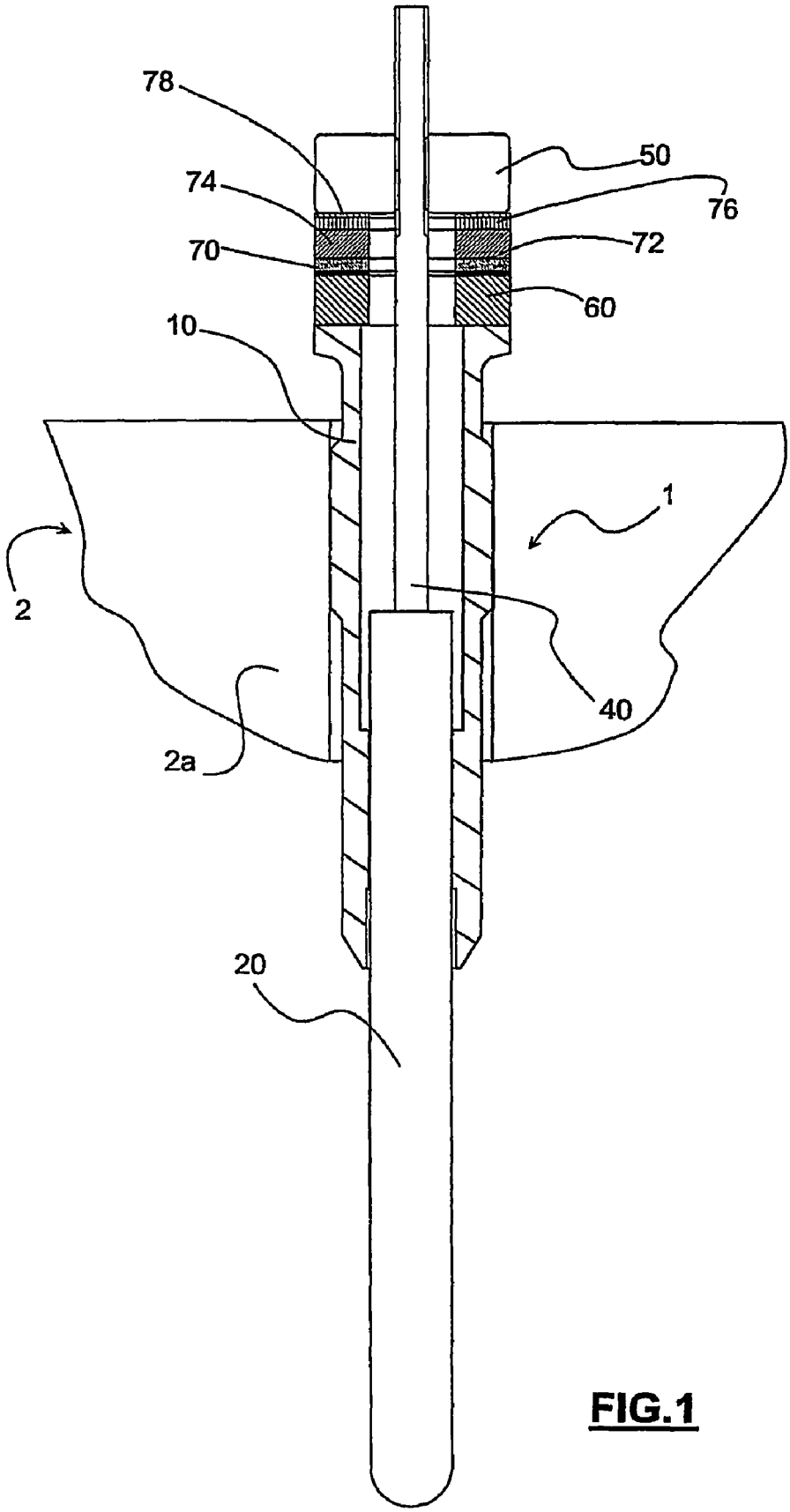
FIG. 1 represents a cross-section of a glow plug of the prior art.
Figure 2:
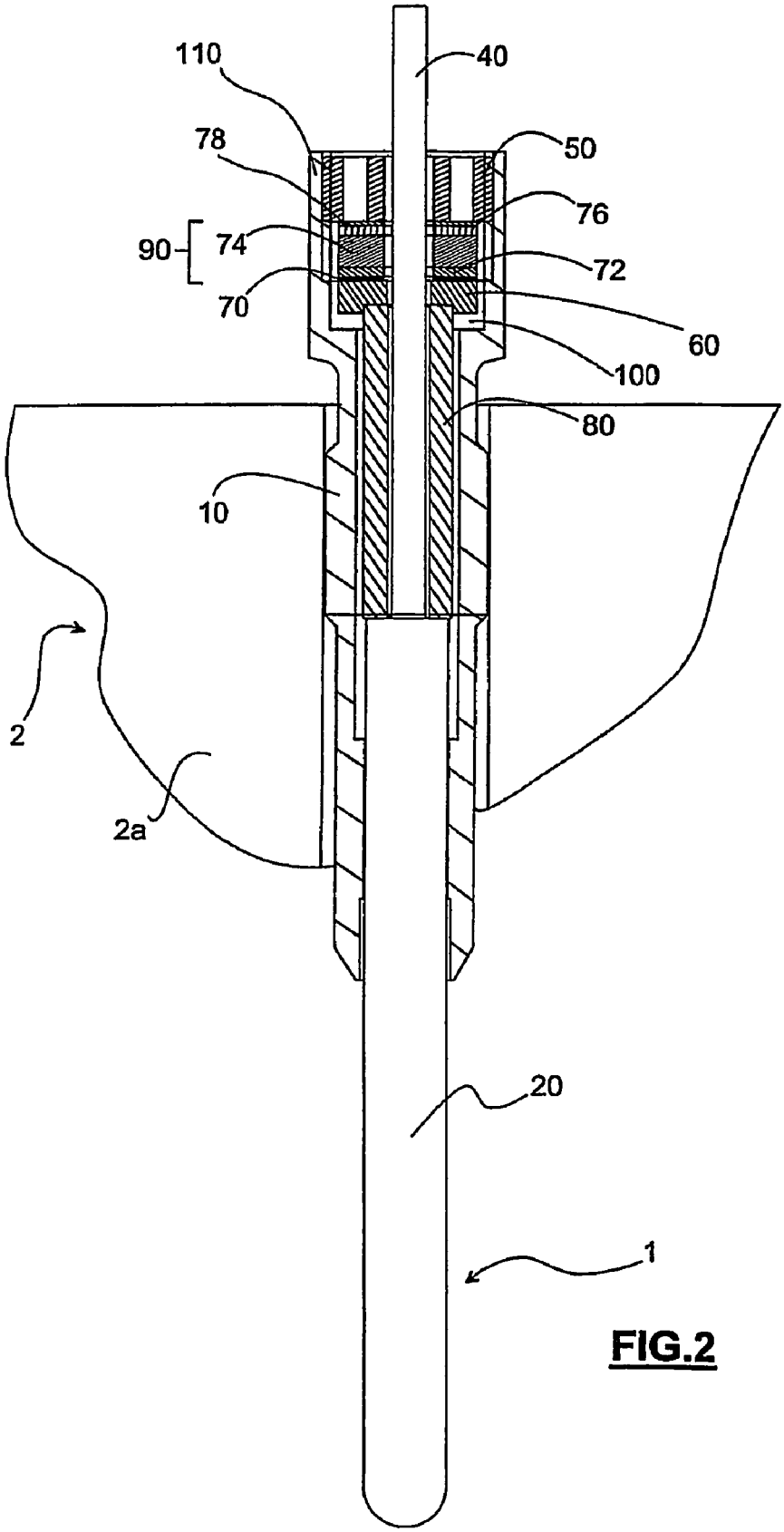
FIG. 2 represents a view similar to FIG. 1 of a glow plug in accordance with the present invention.
Figure 3:
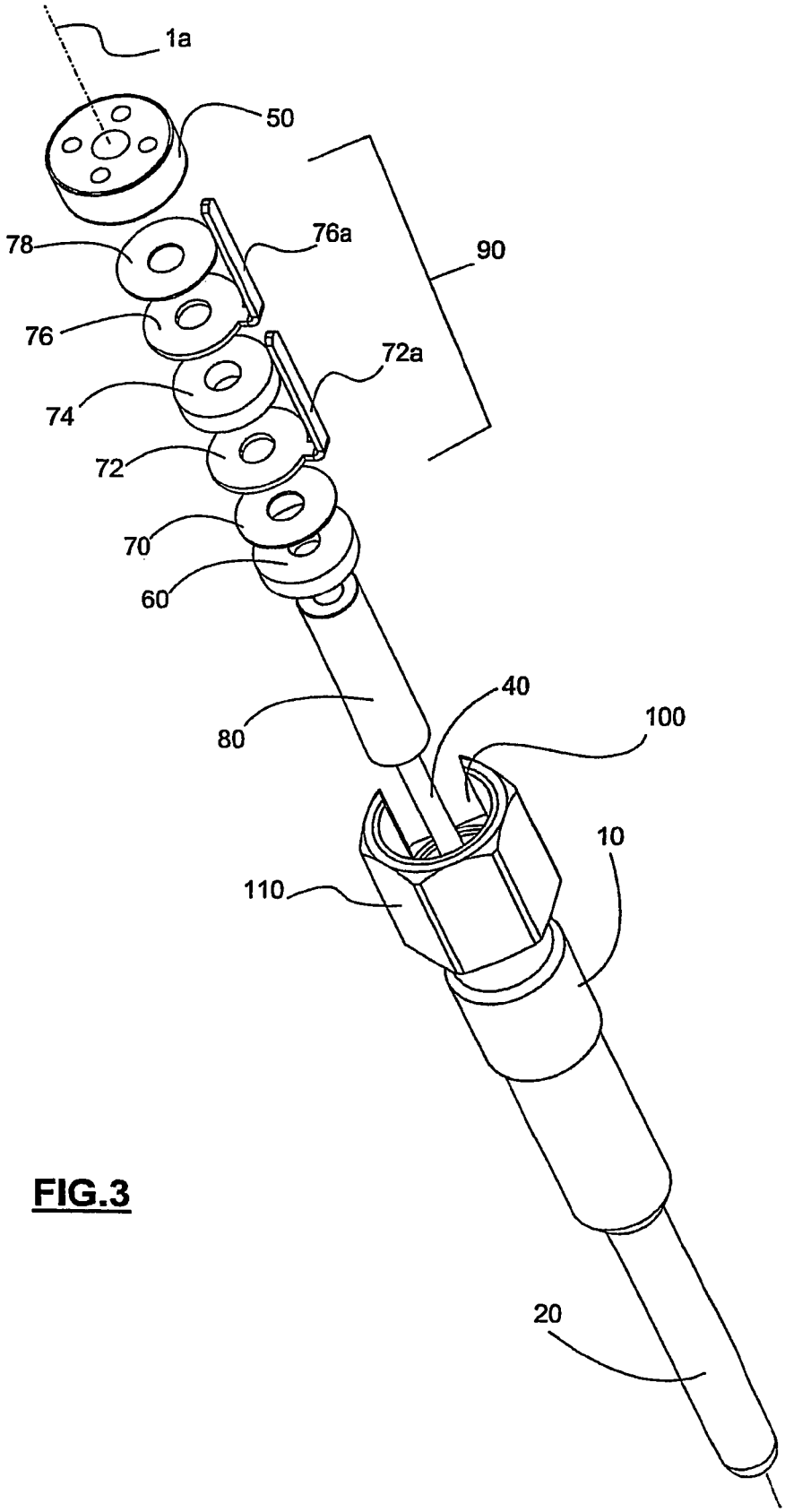
FIG. 3 is an exploded perspective view of the glow plug illustrated in FIG. 2.
Figure 4:
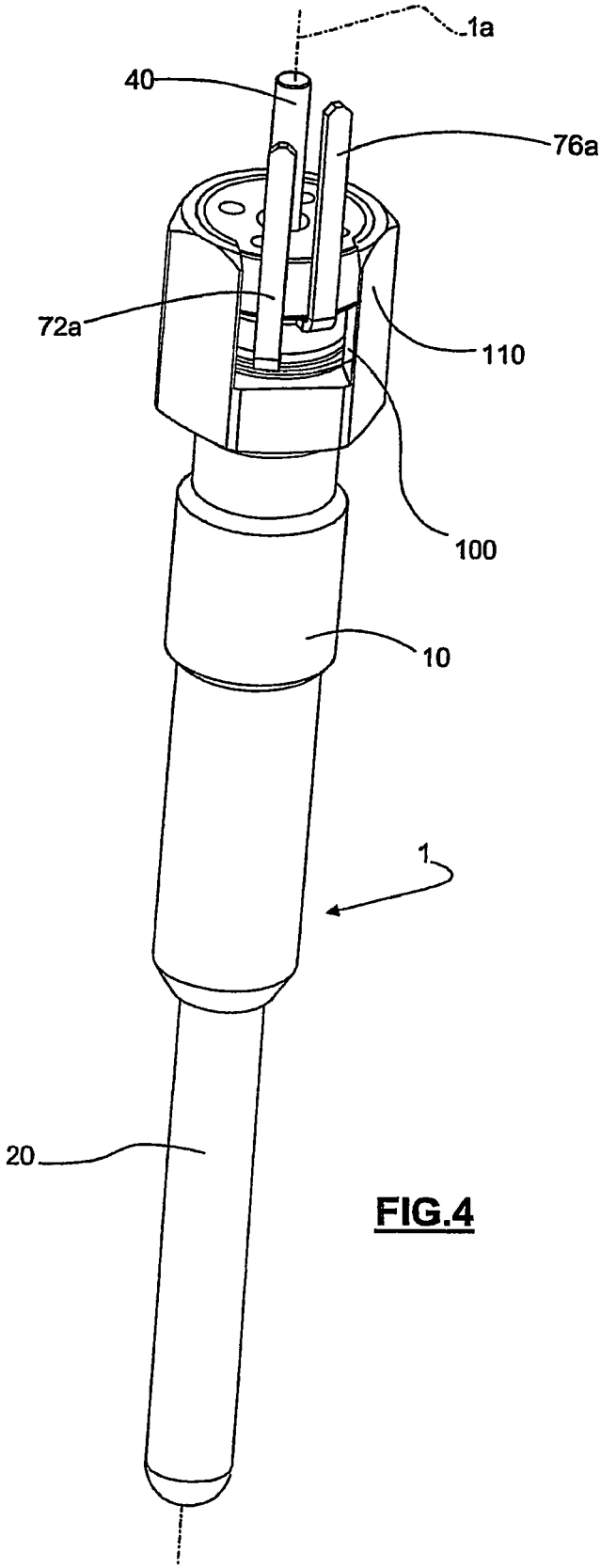
FIG. 4 is a perspective view of the glow plug illustrated in FIGS. 2 and 3.

As can be seen in FIGS. 2, 3 and 4, a glow plug 1, here for an internal combustion engine 2 (typically a Diesel engine, cylinder head 2*a*) comprises a body 10, a finger 20, a core 40 and a pressure sensor 90.

In a conventional manner, the body 10 is adapted to be fixed to the engine 2, for example by screwing to the cylinder head 2*a*. The finger 20, within which is accommodated the pre-heating electrode of the glow plug 1, is disposed in the body 10 and is attached thereto by crimping. The core 40 transmits the electrical energy to the electrode situated in the finger 20 and is thereby in contact with that electrode and is connected to the finger 20 which it extends within the body 10, and beyond (its free end, enabling its electrical connection to an electrical conductor for supply, projects out from the body 10).

The pressure sensor 90 is adapted to measure the internal pressure of the cylinder (or one of the cylinders) of the engine. In the present example, the sensor 90 comprises a piezoelectric member 74 arranged between two contact members 72, 76 of electrically conductive material, and which Is electrically Insulated from the rest of the glow plug 1, in this case by two electrically insulating members 70, 78. The members 72, 76 each comprise a bent lateral electrical connection tab 72*a*, 76*a* directed towards the free end of the core 40 and extending substantially parallel to the longitudinal axis 1 a of the glow plug (cf. FIGS. 3 and 4).

According to the Invention, the sensor 90 is connected to the body 10 by its upper surface and bears against the finger 20, such that the pressure exerted on the finger 20 compresses it against the body 10.

It is clear that any compression of the finger 20 directly results In compression of the sensor 90 against the body 10. Thus, the sensor 90 no longer needs to be pre-stressed to measure the pressures existing in the engine.

As can be seen in FIG. 2, the core 40 passes through the sensor 90 but is not In contact with the latter. On account of this, the vibrations of the core 40 are not transmitted to the sensor 90. Thus the function of the core 40 is essentially only the transmission of the electrical current to the pre-heating electrode of the finger 20, as in the pre-heating electrodes without a pressure sensor.

In the present example, the sensor 90 bears on a spacer 80 which rests on the finger 20 and which is disposed in the body 10, without contact with the latter. Naturally, the spacer 80 which surrounds the core 40, Is not in contact with it, This spacer 80, without modifying the dimensions of the finger 20 and of the body 10, makes it possible to accommodate the sensor 90 in the upper portion of the glow plug 1, and not in the body 10 at the location of the upper end of the finger 20 which would give rise to supplementary stresses (obligation to use sensors of very small outer diameter having lower sensitivities and exposure to higher temperatures generated by the finger 20).

As can be seen in FIG. 2, the sensor 90 is disposed in a cavity 100 formed at the upper end of the body 10, the upper end of the spacer 80 projecting beyond the bottom wall of the cavity 100 such that the sensor 90 does not rest on the body 10.

The location of the sensor 90 in the body 10 makes it easy to form an overmolding of plastics material of the upper portion of the glow plug 1, the overmolding making it possible to ensure the fluid-tightness and to perfect the electrical connection of electrical wires to the connectors of the sensor 90, The spacer 80 is formed of a material giving It a good level of stiffness (given the dimensional constraints imposed by the inner diameter of the body 10, the outer diameter of the core 40 and the respective lengths of the body 10 and of the finger 20), and enabling it to have its own vibrational mode (markedly) beyond the bandwidth of the sensor 90 (thus, the spacer 80 Is not itself subjected to vibrations liable to cause interference to the measurements made by the sensor 90).

Preferably, the spacer 50 is formed of ceramic, this material having the different properties desired (insulation, stiffness, vibrations beyond the bandwidth and good mechanical strength at high temperatures).

Furthermore, in the present example, a bearing piece 60 is interposed between the sensor 90 and the spacer 80 in order to distribute the pressure from the spacer 80 over the whole surface of the sensor 90.

The glow plug 1 also comprises a nut 50 disposed on the sensor 10, and of which the screwing onto the body 10 gives rise to the compression of the sensor 90 against the finger 20 (via the spacer 80 and the bearing piece 60) and its connection to the body 10.

The nut 50 which is connected to the body 10 and which, of course, is not in contact With the core 40 makes it possible to appreciably dampen the vibrations of the electrical connectors of the sensor 90, by compressing the sensor.

In the present example, the screw thread of the nut 50 is formed on its outer periphery and cooperates with an internal screw thread formed on the Inner surface of the side walls 110 of the cavity 100.

Thus, forming the glow plug 1 according to the present embodiment is particularly simple: it is composed of a stack of parts; no severe pre-stress of the sensor 90 is necessary, it suffices to compress it lightly to prevent it from moving. Furthermore, since the core is no longer used to transmit the pressure variations to the sensor, it is possible to reduce its diameter and thus to use a sensor 90 having inner and outer diameters that are relatively small (for example an inner diameter of 2.6 millimeters and an outer diameter of 8.5 millimeters).

Of course, it Is possible to modify the present embodiment.

The invention claimed is:

1. A glow plug (1) comprising:

a pressure sensor (90) adapted to measure the internal pressure of the cylinder of an engine in which the glow plug (1) is accommodated a body (10) adapted to be fixed to the engine, and a finger (20) in which a preheating electrode is accommodated, wherein the pressure sensor (90) is connected to the body (10) by the pressure sensor's upper surface and bears against the finger (20) via of a spacer (80), such that the pressure exerted on the finger (20) compresses the sensor against the body (10), and the spacer (80) is formed from a material of which the spacer's own vibration mode is beyond the bandwidth of the sensor (90).

2. The glow plug (1) according to claim 1, wherein the spacer (80) is of ceramic.

3. The glow plug (1) according to claim 1, further comprising:

a nut (50) is screwed to the body (10) and compresses the sensor (90) so as to connect the sensor to the body (10), wherein the screw thread of the nut (50) is formed on the nut's outer periphery and cooperates with a screw thread formed on the inner surface of the side walls (110) of a cavity (100) in which the sensor (90) is accommodated.

4. The glow plug (1) according to claim 1, wherein a nut (50) is screwed to the body (10) and compresses the sensor (90) so as to connect the sensor to the body (10).

5. The glow plug (1) according to claim 2, wherein a nut (50) is screwed to the body (10) and compresses the sensor (90) so as to connect the sensor to the body (10).

6. The glow plug (1) according to claim 5, wherein the screw thread of the nut (50) is formed on the nut's outer periphery and cooperates with a screw thread formed on the inner surface of the side walls (110) of a cavity (100) in which the sensor (90) is accommodated.

7. An internal combustion engine comprising:

at least one cylinder; and one glow plug (1), comprising:

a pressure sensor (90) adapted to measure the internal pressure of the cylinder of an engine in which the glow plug (1) is accommodated a body (10) adapted to be fixed to the engine, and a finger (20) in which a preheating electrode is accommodated, wherein the pressure sensor (90) is connected to the body (10) by the pressure sensor's upper surface and bears against the finger (20) via of a spacer (80), such that the pressure exerted on the finger (20) compresses the sensor against the body (10), and the spacer (80) is formed from a material of which the spacer's its own vibration mode is beyond the bandwidth of the sensor (90), wherein the pressure sensor (90) is adapted to measure the internal pressure of the cylinder in which the glow plug (1) is accommodated, and in which the body (10) is fixed to the engine.

* * * * *